US006495775B2

(12) United States Patent
Lawson et al.

(10) Patent No.: US 6,495,775 B2
(45) Date of Patent: Dec. 17, 2002

(54) POWER SOCKET DEVICE WITH ENABLING SWITCH AND METHOD OF OPERATION

(75) Inventors: Richard Lawson, Newtown, NY (US); Ali El-Haj, Trumbull, CT (US)

(73) Assignee: Casco Products Corporation, Bridgeport, CT (US)

( * ) Notice: Subject to any disclaimer, the term of this patent is extended or adjusted under 35 U.S.C. 154(b) by 0 days.

(21) Appl. No.: 09/781,384

(22) Filed: Feb. 12, 2001

(65) Prior Publication Data

US 2002/0112945 A1 Aug. 22, 2002

(51) Int. Cl.[7] ..... H01H 9/20

(52) U.S. Cl. ..... 200/50.28; 200/43.01; 200/51 R; 200/333

(58) Field of Search ..... 200/43.01, 43.04, 200/43.16, 43.22, 51 R, 51.09, 51.11, 333, 334, 50.28

(56) References Cited

U.S. PATENT DOCUMENTS

| | | | | | |
|---|---|---|---|---|---|
| 2,439,708 | A | | 4/1948 | Abraham | 200/50 |
| 3,596,019 | A | | 7/1971 | Koester | 200/51.09 |
| 3,781,495 | A | | 12/1973 | Splingaerd | 200/50 |
| 4,148,536 | A | | 4/1979 | Petropoulsos et al. | 339/42 |
| 4,772,215 | A | | 9/1988 | Falk | 439/188 |
| 4,927,373 | A | | 5/1990 | Dickie | 439/188 |
| 5,095,182 | A | | 3/1992 | Thompson | 200/51.09 |
| 5,112,237 | A | | 5/1992 | Yang et al. | 439/188 |
| 5,113,045 | A | | 5/1992 | Crofton | 200/51.09 |
| 5,256,076 | A | | 10/1993 | Hamlin | 439/188 |
| 5,277,602 | A | * | 1/1994 | Yi | 439/138 |
| 5,320,545 | A | | 6/1994 | Brothers | 439/188 |
| 5,347,095 | A | | 9/1994 | Zeder | 200/51.09 |
| 5,374,199 | A | | 12/1994 | Chung et al. | 439/188 |
| 5,643,012 | A | * | 7/1997 | Mai et al. | 439/622 |
| 5,663,711 | A | * | 9/1997 | Sanders et al. | 340/654 |
| 5,865,635 | A | | 2/1999 | Hsiang et al. | 439/188 |
| 5,928,019 | A | | 7/1999 | Chen et al. | 439/188 |
| 5,984,700 | A | | 11/1999 | Chang | 439/139 |
| 6,111,210 | A | | 8/2000 | Allison | 200/51.09 |

* cited by examiner

*Primary Examiner*—Elvin Enad
*Assistant Examiner*—Kyung S. Lee
(74) *Attorney, Agent, or Firm*—Mitchell D. Bittman; Louis C. Dujmich; Brendan J. Kennedy

(57) ABSTRACT

A socket provides power to a mating connector plug when actuated by a switch integral with the socket. The switch can be actuated by insertion of the connector plug, by pivoting open a socket cover, by sliding a slide cover into an operational position, or by a combination of the above. The switch is isolated from the power supplied to the socket and acts as a power supply signal to enable socket power. The socket is powered only when needed as indicated by the actuation method, thereby reducing draw on a power supply connected to the socket. The switch actuation methods described also provide safety features by disabling power to the socket unless the socket is actually in use. The socket cover and slide cover also prevent access to the socket unless positioned to receive a connector.

42 Claims, 8 Drawing Sheets

POWER SOCKET DEVICE WITH ENABLING SWITCH AND METHOD OF OPERATION

BACKGROUND OF THE INVENTION

1. Field of the Invention

The present invention relates generally to a power socket with a switch for enabling power supply to the socket. More specifically, the present invention is related to a power socket that can be enabled using switches that are isolated from socket power, and actuated by some type of user intervention.

2. Description of the Related Prior Art

Power sockets that provide activation/de-activation switching of the power supplied to the socket are known in the art. For example, switched sockets are known that activate/de-activate a power socket based on safety criteria. U.S. Pat. No. 5,865,635 to Hsiang et al. is representative of this type of socket, in which power is supplied to the socket only upon insertion of a mating connector plug. The prongs of the mating connector plug activate contacts within the socket that provide power to the various legs of the plug prongs inserted into the power socket. Each prong of the inserted mating plug activates a contact which enables power to another prong of the mating connector socket. This arrangement provides a safety feature, whereby an object inserted into one of the socket receptacles will not cause that receptacle to be powered, thereby reducing the possibility of electric shock.

Other known socket configurations include that represented by U.S. Pat. No. 5,374,199 to Chung, in which a power socket is activated only upon activation of a plunger type mechanism, which closes contacts within a socket to provide power to the inserted prongs of the mating connector plug. This feature provides a safety and security feature, because the socket remains unpowered until an appropriately configured mating connector plug is inserted into the socket.

Similarly, U.S. Pat. No. 5,984,700 to Chang discloses a socket which remains unpowered until a mating connected plug is fully inserted and rotated 90 degrees. The mating connector plug only receives power once it has been inserted into the socket and rotated 90 degrees, upon which contacts within the socket are closed to provide power to the various socket terminals. In addition, once the mating connector plug is inserted and rotated 90 degrees in the socket, the mating connector plug is secured within the socket, thereby providing a feature which prevents the unintentional disconnection of the socket and plug once power is being supplied.

Finally, U.S. Pat. No. 3,781,495 to Splingaerd shows a socket provided with an access cover, which disconnects power to the socket once it is pivoted away from the socket receptacle. The pivoted socket cover interrupts power to at least one leg of the connector socket, which interrupts the power supply to the mating connector plug. In addition, since the socket cover prevents access to the socket unless it is pivoted open, the cover acts as a safety shut-off, useful for devices drawing power from the socket, in addition to preventing potential harm to an individual accessing the socket.

In all of the above disclosures, the actuating switches that provide power to the socket receptacles also carry socket power. That is, the switching elements are typically contacts which conduct power to a particular terminal of the socket once actuated. The devices of the prior art typically do not disable power to a socket completely, nor do they control switching of the power source that provides power to the socket. Moreover, the prior art does not show any way of determining whether the socket is powered based on simple visual observation.

The present invention overcomes the drawbacks of the prior art by providing a switched power socket in which the switching signal can be isolated from socket power. The present invention further provides an indication of whether the socket is powered. Furthermore, the present invention provides several safety features which help to ensure safe and proper operation of the socket.

SUMMARY OF THE INVENTION

Briefly stated, a socket provides power to a mating connector plug when actuated by a switch integral with the socket. The switch can be actuated by user action, including, e.g., inserting a connector plug, pivoting open a socket cover, sliding a slide cover into an operational position, or a combination of the above. The switch is isolated from the power supplied to the socket and acts as a power supply signal to enable socket power. The socket is powered only when needed as indicated by the actuation method, thereby reducing draw on a power supply connected to the socket. The switch actuation methods described also provide safety features by disabling power to the socket unless the socket is actually in use. The socket cover and slide cover also prevent access to the socket unless positioned to receive a connector.

According to an embodiment of the present invention, there is provided a socket for providing electrical power, comprising: a housing having an inner chamber, at least one electrically conductive terminal in the inner chamber, the at least one terminal being connectable to an electric power source, the at least one terminal being accessible through an opening in a wall of the housing to supply electric power from the power source to a connector insertable through the opening, a socket enable switch operable to permit application of the electric power to the at least one terminal and the socket enable switch being isolated from the electric power.

According to another embodiment of the present invention, there is provided a socket for providing electrical power, comprising: a housing having an inner chamber, at least one electrically conductive terminal in the inner chamber, the at least one terminal being connectable to an electric power source, the at least one terminal being accessible through an opening in a wall of the housing to supply electric power from the power source to a connector insertable through the opening, an opening cover positionable in at least a first and a second position, the opening cover permitting access to the at least one terminal through the opening when in the first position, the opening cover preventing access to the at least one terminal through the opening when in the second position and a socket enable switch operable to permit application of the electric power to the at least one terminal when the opening cover is in the first position.

According to another embodiment of the present invention, there is provided a method for controlling power supplied to a socket, comprising: providing a switch operable to permit application of electric power from an electric power source to a socket terminal, actuating the switch by at least one of: inserting a mating connector into the socket, pivoting a cover on the socket and sliding a slide cover on the socket; wherein the switch is isolated from the electric power.

BRIEF DESCRIPTION OF THE DRAWINGS

The above, and other objects, features and advantages of the present invention will become apparent from the following description read in conjunction with the accompanying drawings, in which.

DETAILED DESCRIPTION OF THE PREFERRED EMBODIMENTS

Figure 1A:
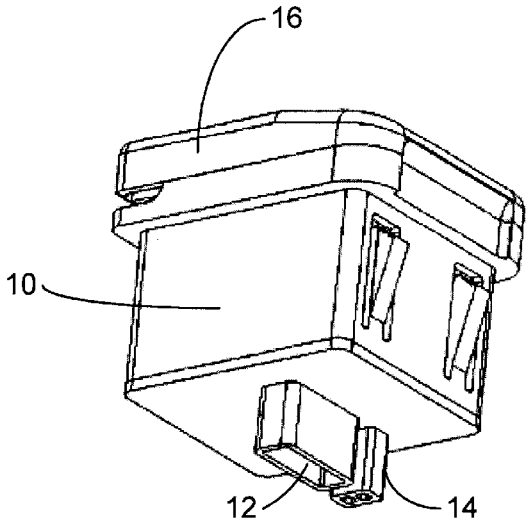
FIGS. 1(*a*), (*b*) and (*c*) are various perspective views of the power socket according to the present invention.
Figure 1B:
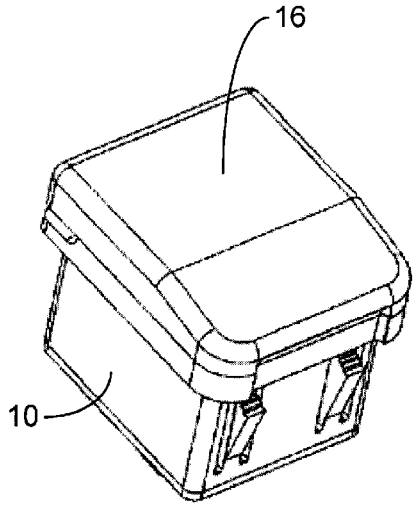
Figure 1C:
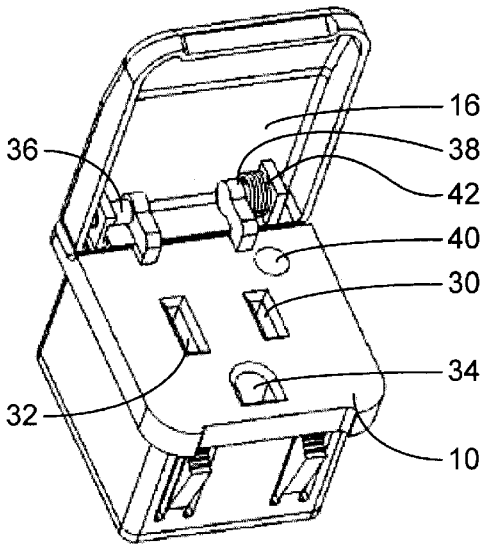

Referring now to FIGS. 1(*a*), (*b*) and (*c*), a socket 10 according to the invention is shown. FIG. 1(*a*) shows a lower exterior surface of socket 10 including plugs 12, 14. Preferably, plug 12 provides a connection for socket power, while plug 14 provides an electrical connection for a socket switch capable of enabling/disabling socket power.

A cover 16 is arranged on socket 10 to prevent or permit access to plug receptacles 30, 32 and 34, shown in FIG. 1(*c*). Cover 16 is attached to socket 10 with hinges 36, 38, which allow cover 16 to pivot open and close, to permit or prevent access to plug receptacles 30, 32 and 34, respectively. Hinge 38 preferably has a spring 42, which engages socket 10 and cover 16 to urge cover 16 into a closed position, as illustrated in FIG. 1 (*b*).

Referring to FIGS. 1(*c*) and 2, a socket power indicator cover 40 is located on a top surface of socket 10, and transfers a light indication when power is applied to the power terminals accessible through plug 12. Indicator cover 40 preferably transfers light from a lamp or an LED, such as LED 68. LED 68 is connected across power terminals within plug receptacles 30 and 32, for example, through an appropriate limiting resistance. Indicator cover 40 provides a simple visual indication that power is supplied to socket 10.

Figure 3:
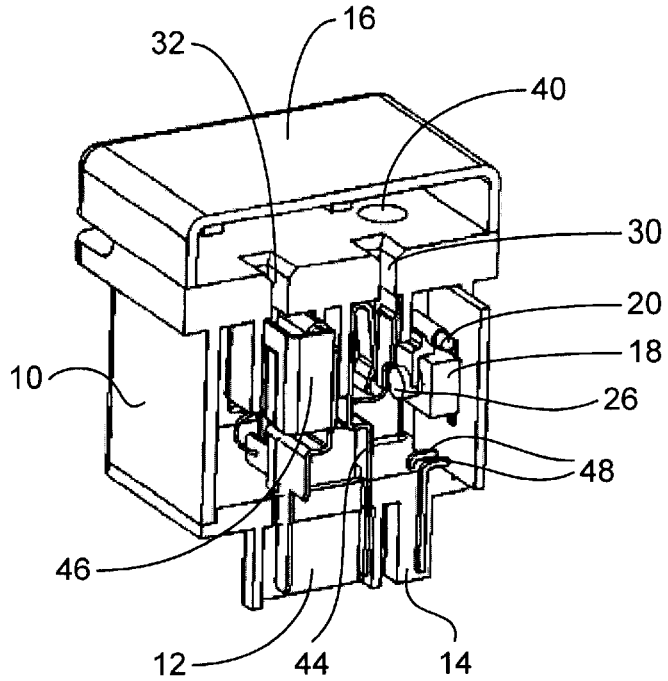
FIG. 3 is a cross sectional perspective view of a first embodiment according to the present invention.

Referring now to FIG. 3, a switch 18 is mounted in socket 10. Switch 18 is sized so as to be positioned between a terminal, e.g., a hot terminal 44, and an internal surface of socket 10. Switch 18 includes a switch hinge 20 that can pivot to provide internal contact connection/disconnection (not shown). Hinge 20 is connected to a preferably insulated switch lever 26, which rotates about hinge 20 and can actuate internal contacts within switch 18. Lever 26 is urged toward hot terminal 44, which permits the internal contacts within switch 18 to be in an open state in the absence of a connector plug prong inserted into hot terminal 44. A resilient member (not shown) within switch 18 provides a pre-loaded force., for example, to urge lever 26 towards hot terminal 44. Switch hinge 20 can alternatively provide a force against lever 26 through a pre-loaded member such as a spring, or other resilient member, for example.

The internal contacts within switch 18 are connected to two switch terminals 48, which are housed within plug 14. Upon actuation, switch 18 causes a contact to be made between switch terminals 48, to complete an electrical circuit through switch terminals 48 extending through plug 14.

A neutral terminal 46 and hot terminal 44 have connection leads that extend through plug 12. Hot terminal 44 and neutral terminal 46 are shaped to receive connecting prongs of a mating connector plug inserted through plug receptacles 30 and 32, respectively. By receiving the connecting prongs of a mating connector plug, hot terminal 44 and neutral terminal 46 provide an electrical connection to the connecting prongs, and are thus capable of supplying power to the mating connector plug and any device to which the plug is connected.

Figure 8A:
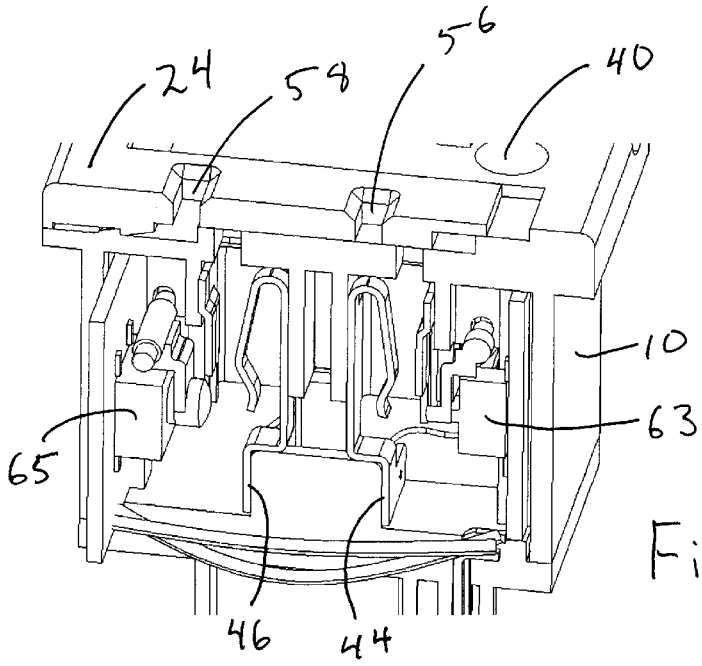
FIGS. 8(*a*) and (*b*) are cross sectional perspective views of a combination of embodiments according to the present invention.
Figure 8B:
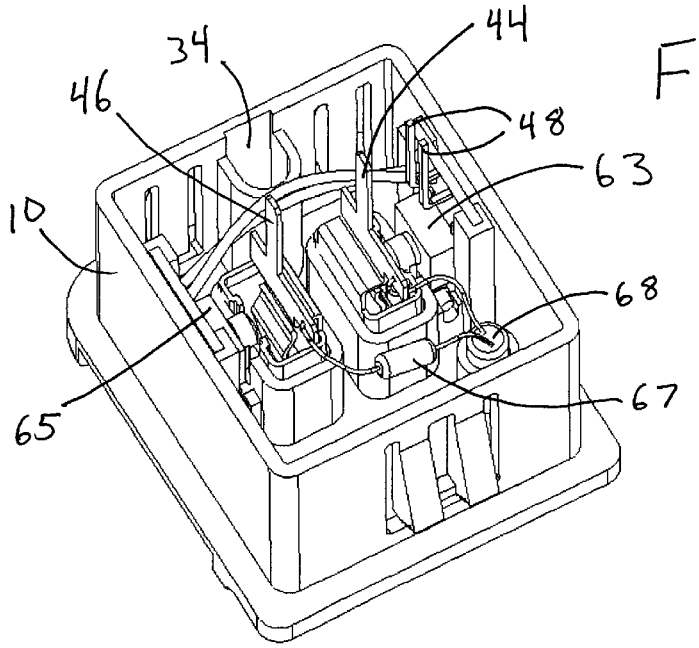

Referring for a moment to FIGS. 8(*a*) and (*b*), the above described embodiment of the present invention is optionally arranged in a number of variations. For example, socket 10 may contain several switches, such as switches 63, 65 arranged adjacent to various portions of both hot terminal 44 and neutral terminal 46. Optionally, a switch similar to switch 18 can be arranged adjacent to ground plug receptacle 34, alone or in combination with switches 63, 65 arranged adjacent to terminals 44, 46. The switches 63, 65 can be arranged in series, so that each switch 63, 65 must be closed before power is permitted to flow to socket 10. While switches 63, 65 are shown as being connected independently of hot terminal 44 and neutral terminal 46 in FIGS. 8(*a*) and (*b*), switches 63, 65 can also be used to directly switch and conduct electrical power to hot terminal 44 or neutral terminal 46, provided they are constructed to have appropriate current and voltage ratings.

Referring again to FIG. 3, socket 10 operates to provide switched electrical power when a mating connecting plug is inserted into plug receptacles 30, 32 and 34. It should be readily observed that socket 10 can be configured to operate and provide switched electrical power when one or more prongs of a mating connector plug are inserted into any of plug receptacles 30, 32 or 34. Socket 10 is operated by first pivoting cover 16 into an open position in which plug receptacles 30, 32 and 34 are exposed for access. A mating connector plug is then inserted into socket 10, with prongs of the mating connector plug being preferably shape fitted to match the openings defined by plug receptacles 30, 32 and 34. The shape of plug receptacles 30, 32 and 34 prevent insertion of a mating connector plug unless properly oriented. Upon insertion into plug receptacles 30, 32, the prongs of the mating connector plug contact and slide along terminals 44, 46, forming an electrical connection between the prongs and terminals 44, 46. When further inserted into receptacles 30, 32, at least one prong contacts and urges switch lever 26 in a direction away from terminal 44. As the mating connector plug is fully inserted into socket 10, at least one connector prong fully engages switch lever 26 to actuate switch I 8, thereby closing the internal contacts of switch 18. Upon closure of the internal contacts within switch 18, an electrical circuit is completed through switch terminals 48, which signals a power supply to provide electrical power to terminals 44, 46. As the power supply provides power to terminals 44, 46, LED 68 is energized providing light to indicator cover 40, which in turn provides a visual indication that socket 10 is live and capable of providing power.

Figure 10A:
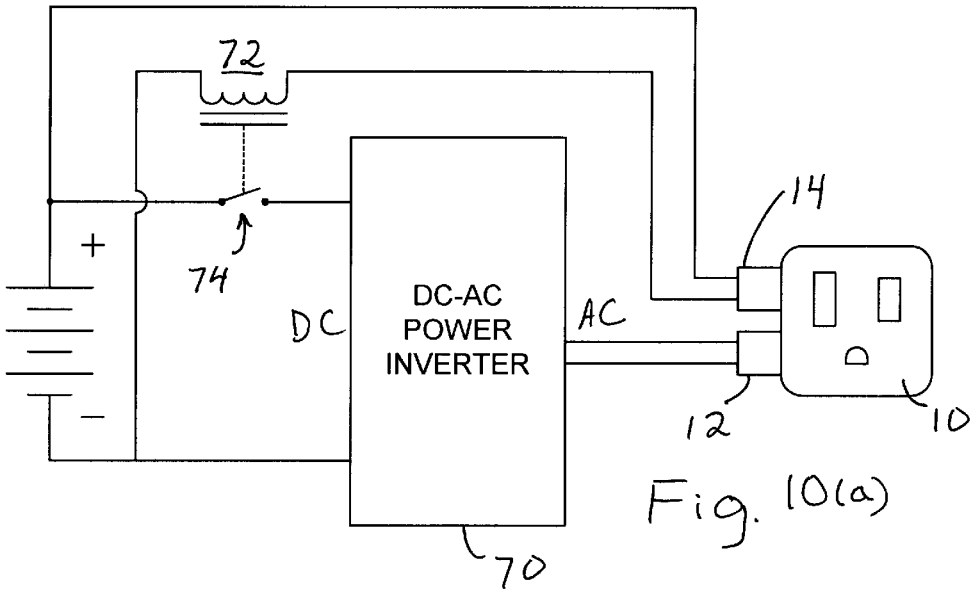
FIGS. 10(*a*) and (*b*) are circuit schematics showing possible configurations of the present invention.
Figure 10B:
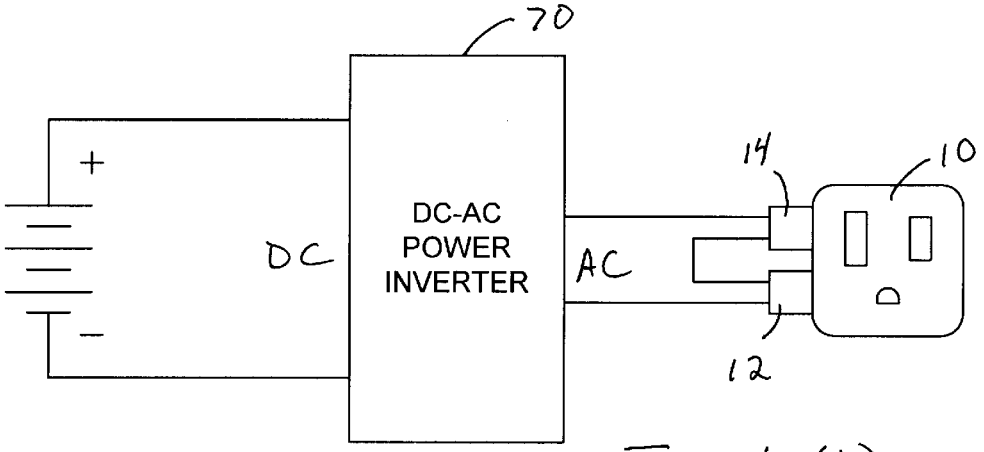

Referring momentarily to FIGS. 10(*a*) and (*b*), configurations of possible circuits incorporating the present invention are shown. Plug 12 of socket 10 in FIG. 10(*a*) is connected to the output of a power inverter 70, for example, an inverter converting a D.C. voltage to A.C., such as 12V D.C. to 120V A.C. Plug 14 is connected to a relay coil 72 with normally open contacts 74 that enables input power to be delivered to inverter 70. When a switch, such as switch 18, 63 or 65 of power socket 10, is closed by user action as described above, relay c(oil 72 is energized and contacts 74 are moved to a closed state. Once contacts 74 are closed, power is supplied to the input of inverter 70.

The circuit shown in FIG. 10(*b*) has the connections to plugs 12 and 14 wired in series. In this configuration, power is always supplied to inverter 70, and the power output of inverter 70 is always available. The output of inverter 70 is switched at socket 10 through plug 14. For example, a switch in a configuration similar to switches 18, 63 or 65 is arranged to cooperate with plug 14 to switch socket power upon user action. Power is permitted to flow through plug 14 to plug 12, and supply a connector plug with power from inverter 70. In an alternate embodiment, plug 14 may not be provided. In this alternate embodiment, switch(es) 18, 63 and/or 65 independently of socket 10 switch power to the socket terminals upon user actuation. Although a DC-AC power inverter supplied with power from a storage battery is shown, any electrical power source, for example an A.C. main source, a D.C. source, etc., can provide power to socket 10. In these embodiments, the socket internal switch(es) 18, 63 and/or 65 is not isolated from the output of the electrical power source.

Figure 2:
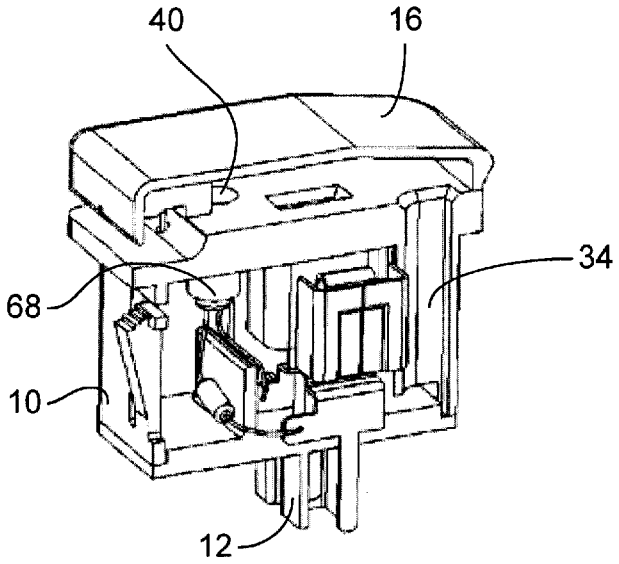
FIG. 2 is a cross sectional perspective view of the power socket according to the present invention.
Figure 4:
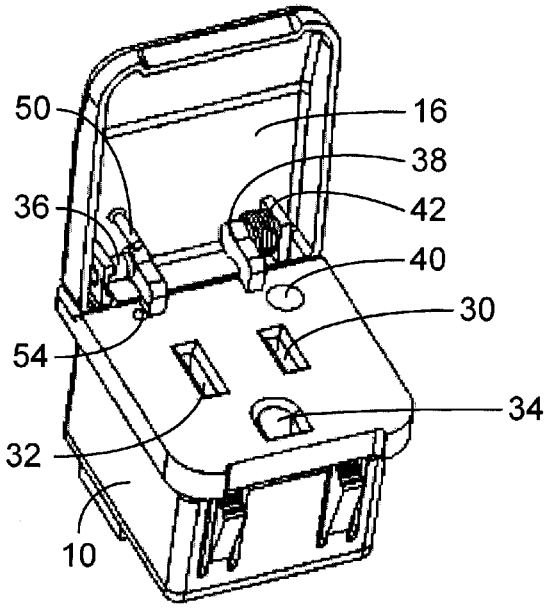
FIG. 4 is a perspective view of a second embodiment according to the present invention.
Figure 5:
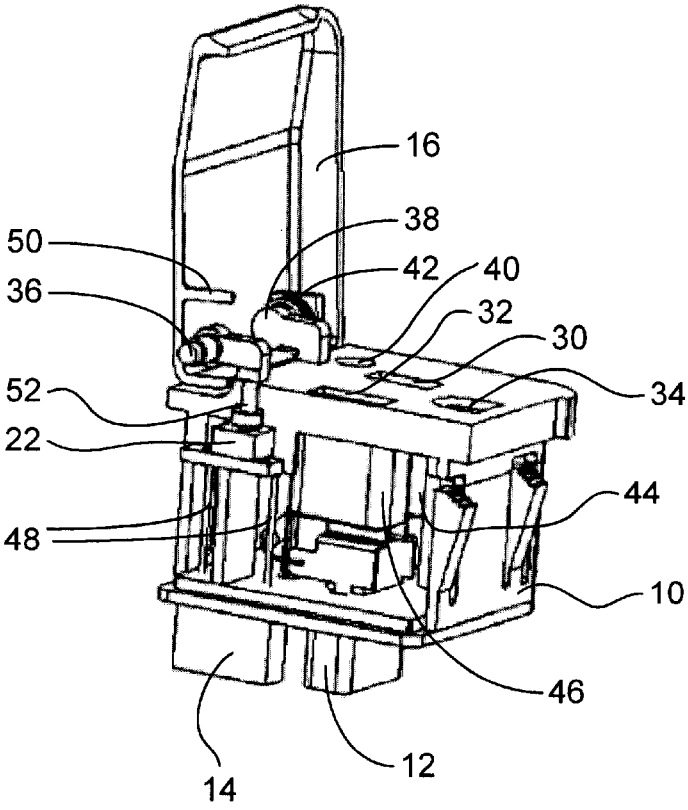
FIG. 5 is a cross sectional perspective view of the embodiment of FIG. 4.

Referring now to FIGS. 4 and 5, a further embodiment of the present invention is shown. In FIGS. 4 and 5, reference designators having the same numeral designation as provided in FIGS. 1–3 indicate like elements, and a description thereof is omitted.

According to the features of this embodiment, FIGS. 4–5 show a cover switch post 50 attached to an inner surface of cover 16. Cover switch post 50 is positioned on the inner surface of cover 16 to be in pivotal alignment and cooperation with a switch opening 54 positioned on a top face of socket 10. Switch opening 54 permits access to a switch plunger 52 that is connected to switch 22 shown in FIG. 5. A force is preferably applied to normally urge switch plunger 52 generally toward cover 16 to keep the switch closed. The force is applied through, for example, a preloaded spring or resilient member connected to switch 22. When switch plunger 52 is in a non-depressed state, internal contacts (not shown) within switch 22 are closed to provide an electrical path between switch terminals 48.

Operation of socket 10 shown in FIGS. 4–5 is controlled by cover 16. When cover 16 is in a closed state, i.e., covering the top surface of socket 10., socket 10 remains unpowered. In the unpowered state, cover switch post 50 projects into switch opening 54 and contacts switch plunger 52. When cover switch post 50 contacts switch plunger 52 as cover 16 is pivoted closed, switch plunger 52 is depressed, forcing the internal contacts within switch 22 into an open state. When the internal contacts within switch 22 are placed in an open state, the electrical connection between terminals 48 is opened, and the power supply to socket 10 is cut off. When the power supply is cut off, terminals 44, 46 are unpowered. Without power supplied to terminals 44, 46, LED 68 is de-energized, thus removing the light source to indicator cover 40 thereby indicating that socket 10 is de-powered.

When cover 16 is pivoted open, cover switch post 50 releases switch plunger 52 from a depressed position. A resilient member within switch 22 urges switch plunger 52 into an up position, generally towards cover 16. When switch plunger 52 is no longer depressed, internal contacts within switch 22 are connected, providing an electrical connection between switch terminals 48. When switch terminals 48 are connected, a power supply to socket 10 is turned on, and power is supplied to terminals 44, 46. Once terminals 44, 46 are powered, LED 68 is energized, providing a light source to indicator cover 40 which provides a visual indication that socket 10 is powered.

Spring 42 connected to hinge 38 normally urges cover 16 into a closed position. Accordingly, cover switch post 50 engages and depresses switch plunger 52 in a normal de-activated state. Cover 16 in combination with cover switch post 50 provide a default fail safe configuration in this arrangement.

A combination of the embodiments shown in FIGS. 1–3 and FIGS. 4–5 may also be provided. In such an arrangement cover 16 actuates a first switch 22 and the prong or prongs of the mating plug to be connected to socket 10 actuate at least one other switch, i.e., switch 18 as in FIGS. 1–3 while the plug is inserted. The two switches can be coupled in series so that power can be applied to the terminals 44 and 46 only if both the cover is opened and the plug is inserted.

Figure 6:
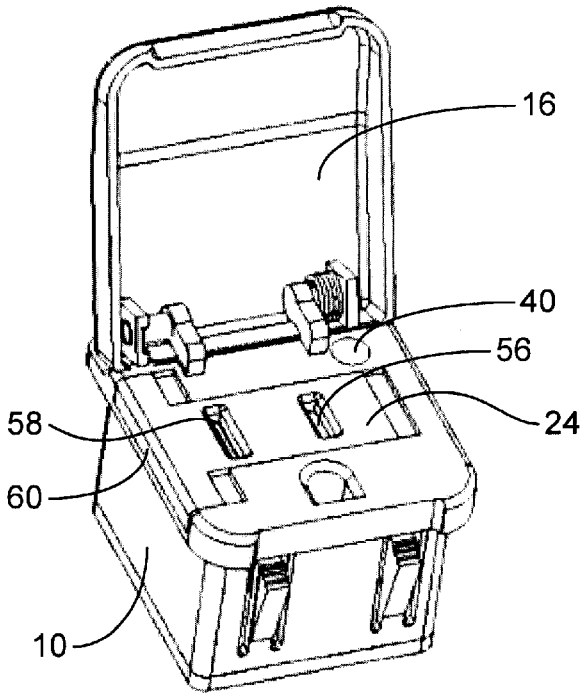
FIG. 6 is a perspective view of a third embodiment according to the present invention.
Figure 9:
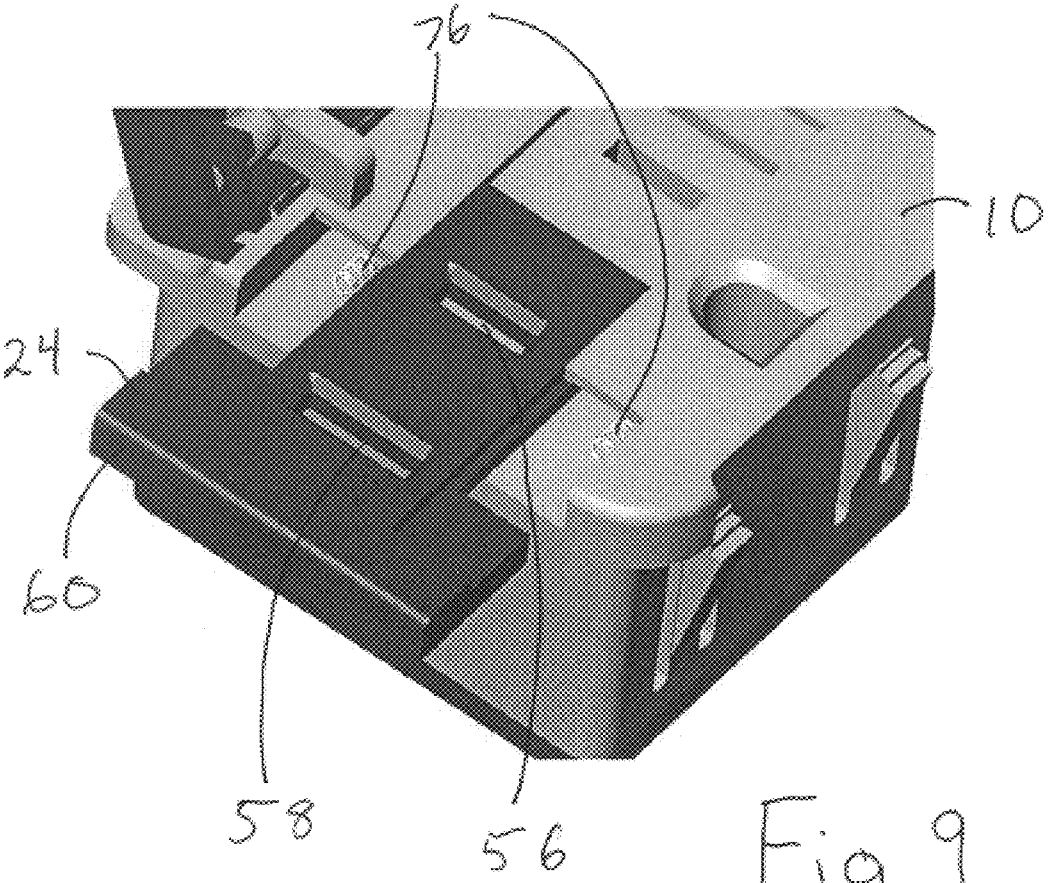
FIG. 9 is a perspective view of an embodiment of the present invention in a partially assembled state.

Referring now to FIG. 6, another embodiment of the present invention is shown. In this embodiment, socket 10 is equipped with a slide cover 24, which includes two openings 56, 58. Openings 56, 58 have substantially the same shape dimension as plug receptacles 30 and 32, respectively. Slide cover 24 is slidable in a lateral direction along the top surface of socket 10. In a fully extended position, an outer edge 60 of slide cover 24 is flush with an edge of the top surface of socket 10. In this position, openings 56, 58 are unaligned with receptacles 30, 32, thereby preventing access to terminals 44, 46. Referring for a moment to FIG. 9, slide cover 24 cooperates with resilient members, such as springs 76 which urge slide cover 24 into the extended position shown in FIG. 6.

Slide cover 24 can be slid into an operating position by the application of a lateral force to outer edge 60 to overcome the urging force of springs 76. When slide cover 24 is thus placed into operating position, openings 56, 58 align with receptacles 30, 32, respectively. Aligned openings 56, 58 and receptacles 30, 32 permit access to terminals 44, 46, respectively. Once slide cover 24 is placed in the operating position, the prongs of a mating connector plug may be inserted into receptacles 30 and 32, to contact terminals 44, 46, and slide cover 24 thereby remains in the operating position.

Figure 7A:
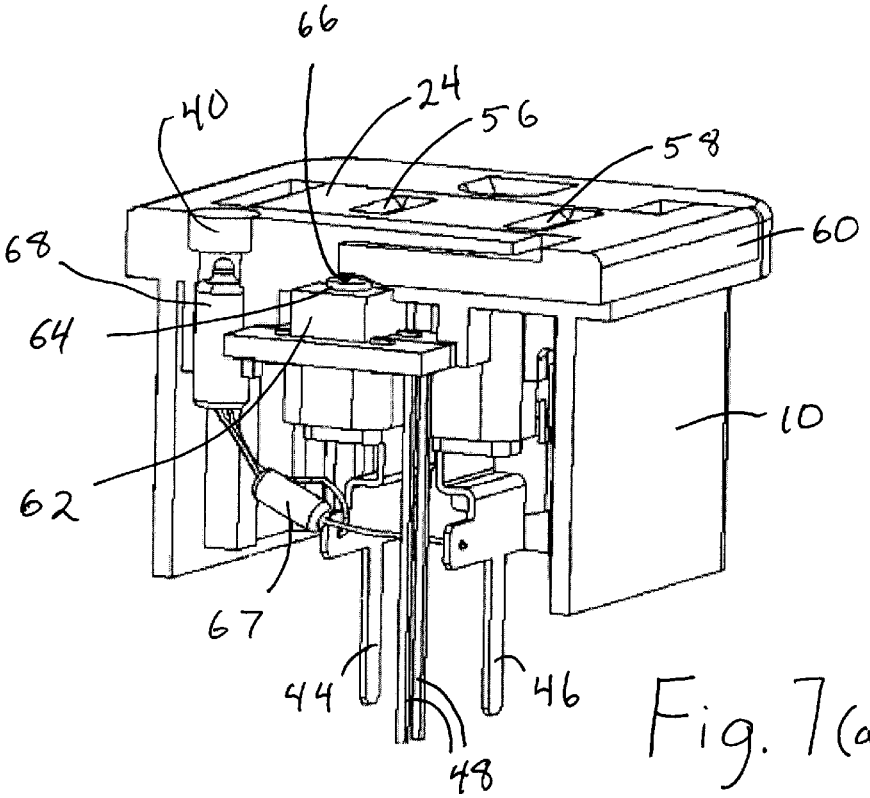
FIGS. 7(*a*) and (*b*) are cross sectional perspective views of the embodiment of FIG. 6.
Figure 7B:
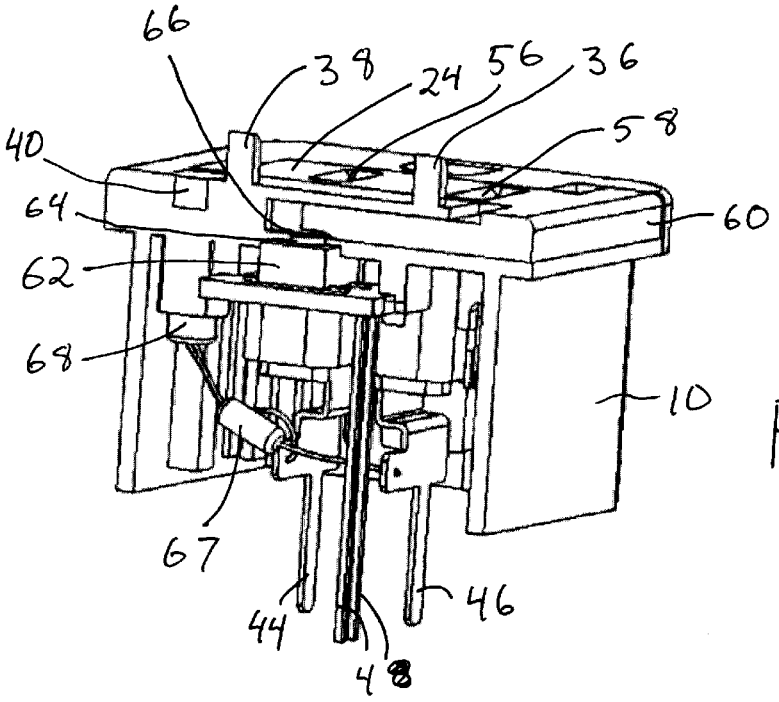

Referring now to FIGS. 7(*a*) and (*b*), a switch 62 is positioned adjacent slide cover 24. FIG. 7(*a*) shows a cross-sectional view of socket 10, while FIG. 7(*b*) shows a cross-sectional view of socket 10 including hinges 36, 38 for reference points. Switch 62 is equipped with a switch plunger 64, which cooperatively engages a sloped portion 66 located on a lower side of slide cover 24. Switch plunger 64 operates a set of internal contacts (not shown) within switch 62 when actuated. In a normal, non-operative state, slide cover 24 is in a position in which outer edge 60 is flush with an edge of the top surface of socket 10. In this state, sloped portion 66 permits switch plunger 64 to extend away from switch 62 in a non-depressed state. Switch plunger 64 is urged upward generally towards the top surface of socket 10 by a resilient member (not shown) within switch 62. When switch plunger 64 is in a raised, or non-depressed state, the internal contacts within switch 62 are separated, and switched terminals 48 remain electrically disconnected.

When slide cover 24 is placed in a normal operative state, sloped portion 66 slides along and gradually depresses switch plunger 64 as slide cover 24 is slid into an operating position. As switch plunger 64 is depressed, the internal contacts within switch 62 are closed, thus providing an electrical connection between switch terminals 48.

Operation of the various embodiments shown in FIGS. 6–9 is explained with the embodiment shown in FIG. 6. Socket 10 is unpowered with cover 16 in a closed position prior to insertion of a mating connector plug. Socket 10 is operated by first pivoting cover 16 into an open position to permit access to slide cover 24. Slide cover 24 is then slid into an operating position by the application of lateral force to outer edge 60, whereby openings 56, 58 align with receptacles 30, 32, respectively. As slide cover 24 is being slid into an operating position, sloped portion 66 slides along and depresses switch plunger 64, causing the internal contacts within switch 62 to become closed. Thus, as slide cover 24 is placed in the operational position, terminals 48 are electrically connected and activate the power supply or otherwise allow power to be applied to socket 10. As the power supply is activated, or power is otherwise supplied to terminals 44, 46, socket 10 becomes powered. Once terminals 44, 46 are powered, LED 68 is energized and provides a visual indication of socket power through indicator cover 40.

Socket 10 is now ready to receive and power an inserted mating connector plug. Once inserted, the mating connector plug prevents slide cover 24 from moving to a non-operational state. The mating connector plug can be easily removed, causing socket 10 to be de-powered due to springs 76 urging slide cover 24 into a non-operational, de-powered state. The removal of a mating connector plug permits slide cover 24 to automatically slide into the extended position with outer edge 60 flush to an edge of the top surface of socket 10. As slide cover 24 slides into the extended position, slope portion 66 disengages and releases switch plunger 64. As switch plunger 64 is released, the internal contacts within switch 62 are opened, thus breaking the electrical connection between terminals 48. Once the electrical connection between terminals 48 is broken, the power supplied to socket 10 is removed and socket 10 is de-powered. Thus, the removal of a mating connector plug from socket 10 disables power and prevents access to receptacles 30, 32. In this default, non-operative state, socket 10 is placed in a fail safe condition.

While various embodiments of the present invention have been described, it should be evident that the embodiments can be selectively combined to produce further embodiments without departing from the scope of the subject matter provided in the present description. For example, socket 10 having a slide cover 24 with corresponding switch 62 can be combined with the embodiment in which switches 18, 63, 65 are provided adjacent respective terminals 44, 46. Alternatively, mechanical linkages may be used to activate the various switches upon the cover being pivoted, the slide cover being slid or a mating plug being inserted. In addition, a user may activate socket 10 with other switching methods accessible to the user. For example, a magnetic or push-button switch may be used to activate socket 10 by user action. Thus, the scope of the invention should not be limited by specific embodiments disclosed, as many possible variations of the present invention are possible through a combination of various features disclosed.

The present invention may be embodied in other specific forms without departing from the spirit or essential attributes thereof and, accordingly, reference should be made to the appended claims, rather than to the foregoing specification, as indicating the scope of the invention.

What is claimed is:

1. A socket for providing electrical power, comprising:

a housing having an inner chamber;

at least one electrically conductive terminal in said inner chamber;

said at least one terminal being connectable to an electrical output of an electric power source;

said at least one terminal being accessible through an opening in a wall of said housing to supply electric power from said electric power source to a connector being insertable through said opening and contacting said at least one terminal;

a socket enable switch operable to permit application of said electric power to said at least one terminal; and said socket enable switch being electrically isolated from said electrical output of said electric power source.

2. The socket according to claim 1, wherein said socket enable switch cooperates with and is operable by at least one of an insertable connector, a slide cover on said opening and a socket cover.

3. The socket according to claim 1, wherein said socket enable switch is actuated through a manual operation performed on said socket.

4. The socket according to claim 1, further comprising a power indicator effective to indicate an application of said electric power to said at least one terminal.

5. The socket according to claim 1, further comprising:

at least one other socket enable switch; and said at least one other socket enable switch being operable in conjunction with said socket enable switch to permit application of said electric power to said at least one terminal.

6. The socket according to claim 5, wherein said at least one other socket enable switch cooperates with and is operable by at least one of another insertable connector, a slide cover on said opening and a socket cover.

7. The socket according to claim 1, wherein said socket enable switch is insulated from said insertable connector.

8. The socket according to claim 7, wherein said socket enable witch comprises an actuator engaged by said insertable connector made of an insulating material.

9. The socket according to claim 1, further comprising:

a socket cover being pivotably positionable in at least a first and a second position;

said opening being inaccessible when said socket cover is in said first position; and said opening being accessible when said socket cover is in said second position.

10. The socket according to claim 9, further comprising:

an urging member; and said urging member effective to urge said socket cover toward said first position.

11. The socket according to claim 1, further comprising:

a slide cover having a slide opening and being slidably positionable in at least a first and a second position;

said slide opening being aligned with said opening in said wall of said housing when said slide cover is in said first position thereby permitting access to said at least one terminal; and a portion of said slide cover covering said opening in said wall of said housing when said slide cover is in said second position thereby preventing access to said at least one terminal.

12. The socket according to claim 1, wherein said socket enable switch is coupled to a control voltage for controlling application of electrical power from said power source to said electrical output of said power source.

13. The socket according to claim 1, wherein said power source comprises a DC-AC inverter.

14. A socket for providing electrical power, comprising:

a housing having a wall defining an inner chamber;

an electrically conductive terminal in said inner chamber and coupled to an electrical power source;

an opening in said wall providing access to said terminal to permit a connector inserted through said opening to contact said terminal;

a socket switch in said inner chamber and operatively coupled to said electrical power source to prevent power from being supplied to said socket when said socket switch is not actuated, said socket switch being electrically isolated from said electrical power source;

a slide cover having a first position overlapping said opening and a second position not overlapping said opening; and said slide cover actuates said socket switch when said slide cover is in said second position.

15. The socket according to claim 12, wherein said control voltage comprises an input voltage to said power source.

16. The socket according to claim 14, further comprising:

a switch actuator on said socket switch capable of being displaced to actuate said socket switch;

a ramp surface on said slide cover operatively coupled to said switch actuator; and said ramp surface displaces said switch actuator to actuate said socket switch when said slide cover moves from said first position to said second position.

17. A socket for providing electrical power, comprising:

a housing having an inner chamber;

at least one electrically conductive terminal in said inner chamber;

said at least one terminal being connectable to an electrical output of an electric power source;

said at least one terminal being accessible through an opening in a wall of said housing to supply electric power from said electric power source to a connector being insertable through said opening and contacting said at least one terminal;

a socket enable switch operable to permit application of said electric power to said at least one terminal; and said socket enable switch being electrically isolated from said electrical output of said electric power source, wherein said socket enable switch comprises a switch actuator.

18. The socket according to claim 17, wherein said switch actuator comprises an insulated hinged member engaged by said insertable connector pivoting along a hinge axis for actuating said socket enable switch.

19. The socket according to claim 17, wherein said actuator comprises a pin disposed on a pivotable cover for said socket, said pin being receivable in an aperture of said socket and engaging with a plunger of said socket enable switch.

20. A socket for providing electrical power, comprising:

a housing having an inner chamber;

at least one electrically conductive terminal in said inner chamber;

said at least one terminal being connectable to an electrical output of an electric power source;

said at least one terminal being accessible through an opening in a wall of said housing to supply electric power to a connector insertable through said opening;

an opening cover positionable in at least a first and a second position;

said opening cover permitting access to said at least one terminal through said opening when in said first position;

said opening cover preventing access to said at least one terminal through said opening when in said second position; and a socket enable switch electrically isolated from said electrical output of said electric power source and operatively coupled to said opening cover to permit application of said electric power to said at least one terminal when said opening cover is in said first position.

21. The socket according to claim 20, wherein said socket enable switch is electrically isolated from said electrical output of said electric power source.

22. The socket according to claim 20, wherein said socket enable switch cooperates with and is operable by at least one of an insertable connector and said opening cover.

23. The socket according to claim 20, further comprising:

an urging member; and said urging member effective to urge said opening cover toward said second position.

24. The socket according to claim 23, wherein said insertable connector maintains said opening cover in said first position when inserted into said opening.

25. The socket according to claim 23, wherein said insertable connector prevents said opening cover from returning to said second position when inserted into said opening.

26. The socket according to claim 20, further comprising a power indicator effective to indicate an application of said electric power to said at least one terminal.

27. The socket according to claim 20, further comprising:

at least one other socket enable switch; and said at least one other socket enable switch being operable in conjunction with said socket enable switch to permit application of said electric power to said at least one terminal.

28. The socket according to claim 27, wherein said at least one other socket enable switch cooperates with and is operable by at least one of another insertable connector and said opening cover.

29. The socket according to claim 20, wherein said socket enable switch is insulated from said insertable connector.

30. The socket according to claim 20, wherein:

said opening cover is slidable; and said socket further comprises a further opening cover being pivotably positionable in at least an open and a closed position;

said opening cover being inaccessible when said further opening cover is in said closed position; and said opening cover being accessible when said further opening cover is in said open position.

31. The socket according to claim 30, further comprising:

an urging member; and said urging member effective to urge said another opening cover toward said closed position.

32. The socket according to claim 20, wherein:

said opening cover has a slide opening and is slidably positionable in said at least first and second position;

said slide opening being aligned with said opening in said wall of said housing when said slide cover is in said first position thereby permitting access to said at least one terminal; and a portion of said slide cover covers said opening in said wall of said housing when said slide cover is in said second position thereby preventing access to said at least one terminal.

33. The socket according to claim 32, wherein said socket enable switch is actuated to permit application of said electric power to said at least one terminal when said slide cover is in said first position.

34. The socket according to claim 20, wherein said socket enable switch is connected to the electrical output of said electrical power source to provide electrical power to the insertable connector when said socket enable switch is activated and said connector is inserted through said opening.

35. The socket according to claim 20, wherein the opening cover is pivotable between said first and second positions, said first position comprising a position permitting access to said at least one terminal and said second position closing off access to said at least one terminal.

36. A method for controlling power supplied to a socket, comprising:

providing a switch in said socket;

maintaining electrical isolation between said switch and electrical power supplied to the socket;

switching said switch to switch electrical power supplied to the socket;

actuating said switch by at least one of:

inserting a mating connector into said socket;

pivoting a cover on said socket; and sliding a slide cover on said socket;

wherein said socket remains unpowered until said switch is actuated.

37. The method according to claim 36, further comprising providing an indication of an application of said electric power to said socket.

38. A socket for providing electrical power from an electrical power source with an output enable, said socket comprising:

a housing having a wall defining an inner chamber;

an electrically conductive terminal in said inner chamber and coupled to said electrical power source;

a socket switch in said inner chamber and coupled to said output enable of said electrical power source, said socket switch being electrically isolated from a power output of said electrical power source;

an opening in said wall providing access to said terminal, said terminal being positioned with respect to said opening to contact an electrical connecter inserted through said opening; and said socket switch is operable to control said output enable to prevent electrical power from being supplied to said socket and said terminal until said socket switch is actuated.

39. A socket according to claim 38, wherein said output enable controls said electrical power source to prevent said electrical power source from being energized to supply power to said socket when said output enable is disabled.

40. A socket according to claim 38, wherein said socket switch is positioned with respect to said opening such that said electrical connector actuates said socket switch when said electrical connector is inserted into said opening.

41. A socket according to claim 38, further comprising:

a socket cover overlaying a portion of said opening and preventing insertion of said connector in a first position;

said socket cover being movable to reveal said opening and permit insertion of said connector in a second position; and said socket cover actuates said socket switch when in said second position to permit electrical power to be supplied to said socket.

42. A socket according to claim 38, further comprising an indicator coupled to said terminal, said indicator operable to provide an indication that electrical power is supplied to said terminal.

* * * * *